US011806757B2

(12) United States Patent
Bron et al.

(10) Patent No.: US 11,806,757 B2
(45) Date of Patent: Nov. 7, 2023

(54) SLACK SEPARATION APPARATUS AND METHOD

(71) Applicant: ISHIDA EUROPE LIMITED, Birmingham (GB)

(72) Inventors: Michael Bron, Helmond (NL); Ruud Schepens, Schijndel (NL)

(73) Assignee: ISHIDA EUROPE LIMITED, Birmingham (GB)

( * ) Notice: Subject to any disclaimer, the term of this patent is extended or adjusted under 35 U.S.C. 154(b) by 440 days.

(21) Appl. No.: 17/280,832

(22) PCT Filed: Oct. 31, 2019

(86) PCT No.: PCT/GB2019/053085
§ 371 (c)(1),
(2) Date: Mar. 26, 2021

(87) PCT Pub. No.: WO2020/089632
PCT Pub. Date: May 7, 2020

(65) Prior Publication Data

US 2022/0001422 A1 Jan. 6, 2022

(30) Foreign Application Priority Data

Oct. 31, 2018 (GB) ..... 1817805

(51) Int. Cl.
*B07B 13/05* (2006.01)

(52) U.S. Cl.
CPC ..... *B07B 13/05* (2013.01)

(58) Field of Classification Search
None
See application file for complete search history.

(56) References Cited

U.S. PATENT DOCUMENTS 2,649,339 A * 8/1953 Schaetzel ..... B65G 53/66 406/122
2,726,762 A * 12/1955 Aubry ..... B07C 5/3425 209/919

(Continued)

FOREIGN PATENT DOCUMENTS

CN 105540282 A 5/2016
EP 1 380 510 A1 1/2004

(Continued)

OTHER PUBLICATIONS

Combined Search and Examination Report under Sections 17 and 18(3) for United Kingdom Application No. GB1817805.3, 6 pages, dated May 1, 2019.

(Continued)

*Primary Examiner* — Charles Capozzi
(74) *Attorney, Agent, or Firm* — Squire Patton Boggs (US) LLP

(57) ABSTRACT

The present disclosure relates to methods and apparatus for separating excess slack out from a mixture of product and slack. For example, the slack could be a food product coating. According to one aspect, there is provided a hopper for diverting excess slack away from a mixture of product and slack, the hopper comprising a gate moveable between open and closed positions, wherein the gate is configured such that: when the gate is in the open position a first path is provided for contents of the hopper, comprising a mixture of product and slack, to exit the hopper; and when the gate is in the closed position the first path is closed by the gate so that product is retained in the hopper and a second path, different from the first path, is provided for slack to exit the hopper.

22 Claims, 5 Drawing Sheets

(56) References Cited

U.S. PATENT DOCUMENTS

| | | | |
|---|---|---|---|
| 3,046,143 | A | 7/1962 | Lowe et al. |
| 2011/0313566 | A1 | 12/2011 | Kim |

FOREIGN PATENT DOCUMENTS

| | | | |
|---|---|---|---|
| EP | 2 940 438 | A1 | 11/2015 |
| KR | 101238705 | B1 | 3/2013 |

OTHER PUBLICATIONS

International Search Report and Written Opinion for PCT international Application No. PCT/GB2019/053085, dated Feb. 5, 2020, 28 pages.
International Preliminary Report on Patentability for PCT international Application No. PCT/GB2019/053085, dated Feb. 16, 2021, 41 pages.

* cited by examiner

SLACK SEPARATION APPARATUS AND METHOD

CROSS-REFERENCE TO RELATED APPLICATIONS

The present application is a national-stage filing under 37 USC 371(c) of International Application No. PCT/GB2019/053085, filed Oct. 31, 2019, which claims the benefit and priority of Great Britain Patent Application No. 1817805.3, filed on Oct. 31, 2018.

FIELD

The present disclosure relates to methods and apparatus for separating excess slack out from a mixture of product and slack. For example, the slack could be a food product coating.

More specifically, aspects relate to a hopper for diverting excess slack away from a mixture of product and slack, apparatus for separating excess slack from a mixture of product and slack comprising said hopper, packaging apparatus comprising said hopper and a method of diverting excess slack away from a mixture of product and slack.

BACKGROUND

Some products are packaged together with additional material, which will be referred to herein as slack. Slack, which is generally of a substantially solid or liquid form, may be mixed with solid product before the mixture is portioned into packaging.

Such slack may be included to protect the product in some way, for example from degradation due to exposure to certain chemicals or due to motion of the product within its packaging. Alternatively or additionally, slack may be included to enhance the product in some way, for example food products may be provided with loose coatings of sugar, breadcrumbs or herbs to improve one or more of their taste, texture, appearance or smell.

In some processes, for example coating processes, it may be necessary to mix a higher ratio of slack to product than is desired in the final packaged product, for example to ensure an even coating can be achieved. This presents a problem however, of how to separate excess slack from the product before packaging.

In some processes if excess slack is separated between mixing of the product and slack and packaging of the product, the excess slack can be fed back into the production line at the point where the product and slack are mixed, providing an advantage of reducing wastage.

For some products it is not desirable for excess slack to be allowed to float freely within the packaging. For example if excess breadcrumbs are floating in the packaging of a breaded food product intended for oven cooking then that excess slack could end up burning on to the oven tray. Separation of excess slack prior to packaging helps to solve this problem.

A further problem can arise where a mixture of product and slack is dropped into packaging, which is subsequently sealed towards its upper end. If the slack falls at a slower rate than the product, for example where the product is a jelly sweet and the slack is a sugar coating, the seal quality may be compromised by slack trapped within the seal. The sealing step can be delayed to avoid this problem by allowing the slack to settle before sealing, but this would of course slow the process speed.

What is needed is an alternative method and apparatus for excess slack separation, which contributes to solving one or more of the problems discussed above and/or provides one or more of the advantages discussed above.

SUMMARY

According to a first aspect, there is provided a hopper for diverting excess slack away from a mixture of product and slack. The hopper comprises a gate moveable between open and closed positions. The gate is configured such that, when the gate is in the open position, a first path is provided for contents of the hopper, comprising a mixture of product and slack, to exit the hopper. The gate is further configured such that, when the gate is in the closed position, the first path is closed by the gate so that product is retained in the hopper and a second path, different from the first path, is provided for slack to exit the hopper. This arrangement means that product can be separated from excess slack by opening and closing the gate as will be described in more detail below.

The first path can comprise a first aperture sized to permit egress of both product and slack, for example into an item of packaging. The second path can comprise a second aperture sized to permit egress of slack (for example for collection and re-use), but not of product.

The hopper can further comprise a retaining wall, wherein the hopper is configured such that the second aperture is a gap between the gate, when in the closed position, and a lower end of the retaining wall.

Preferably the first path and second path extend in different directions. For instance, the hopper can be further configured such that, when the gate is in the open position, the first path directs contents of the hopper out of the hopper under gravity in a first direction. The hopper can be further configured such that, when the gate is in the closed position, the second path directs slack out of the hopper under gravity in a second direction, angled with respect to the first direction.

The retaining wall can be at an acute angle to the vertical such that, when the gate is in the open position, contents of the hopper pass over the retaining wall out of the hopper in the first direction.

The hopper can be configured such that, when the gate is in the closed position, the gate is at an acute angle to the vertical such that slack passes over the gate out of the hopper in the second direction.

The hopper can be configured such that there is a lateral offset between where contents of the hopper exit the hopper via the first path and where slack exits the hopper via the second path. In this way they can be directed into separate vessels.

The hopper can be configured such that, when the gate is in the closed position, a distal end of the gate is laterally offset from the lower end of the retaining wall. In this way the excess slack can be directed into a separate vessel from the product.

The hopper can be configured such that, when the gate is in the closed position, the gate and the retaining wall slope towards one another, with the retaining wall stopping short of the gate to form the gap and the gate extending beyond where the gate and the retaining wall would otherwise intersect. In this way the excess slack can be directed into a separate vessel from the product.

The hopper can comprise a hinge, wherein the gate is configured to be moveable between the open and closed positions by rotation about the hinge.

The hopper can be a weighhopper, pool hopper, booster hopper, timing hopper, output hopper or discharge hopper.

According to modifications of the first aspect, there is provided a hopper comprising two gates, a first gate as discussed above and a further second gate.

Specifically, such hoppers with double-gates may comprise the features any of the embodiments discussed above and a second gate moveable between open and closed positions, such that:

when the first and second gates are in their respective open positions the first path extends between the first and second gates; and when the first and second gates are in their respective closed positions the first path is blocked and the second path extends between the first and second gates.

Thus the first aperture is defined between the first and second gates in their respective open positions, and the second aperture is defined between the first and second gates in their respective closed positions.

Preferably the lower end of the retaining wall is the lower end of the second gate.

Preferably the hopper is configured to move the first and second gates between their respective closed and open positions substantially simultaneously. Such examples in which the first and second gates of a hopper are opened simultaneously (i.e. together or in unison) provide a sudden shock to the contents of the hopper as they are released down the first path. This is particularly well-suited to use with sticky products or combinations of product and slack which might otherwise adhere or stick to the inside of the hopper. Thus hoppers with two gates may be more consistent in discharging product and more reliable.

The hopper may be configured such that, when the first and second gates are in their respective closed positions, a distal end of the first gate is laterally offset from the distal end of a second gate.

The hopper may be configured such that, when the first and second gates are in their respective closed positions, the first and second gates slope towards one another, with the second gate stopping short of the first gate to form the gap and the first gate extending beyond where the gates would otherwise intersect.

The hopper may be configured such that, the length of the first gate is at least 1.2 times greater than the length of the second gate, more preferably at least 1.5 times greater.

The hopper may further comprise a second hinge, wherein the second gate is configured to be moveable between the open and closed positions by rotation about the second hinge.

According to a second aspect, there is provided apparatus for separating excess slack from a mixture of product and slack. The apparatus comprises: the hopper described above; a first chute located so as to receive contents of the hopper exiting the hopper via the first path when the gate is in the open position; and a second chute located so as to receive slack exiting the hopper via the second path when the gate is in the closed position.

The first chute can be arranged with respect to the retaining wall of the hopper such that, when the gate is in the open position, contents of the hopper pass under gravity smoothly from the retaining wall of the hopper onto a receiving surface of the chute. This reduces the chances of any slack coating the product becoming dislodged, since there should be no jolting of the product in the transition from the hopper to the first chute.

The first chute can be formed as a filter configured to permit slack entering the first chute to exit through the first chute into the second chute, but not to permit product entering the first chute to exit through the first chute into the second chute. This allows even more excess slack to be separated from the product prior to packaging, including any slack which becomes dislodged from the product as it enters or traverses the first chute.

The second chute can be arranged concentrically around the first chute. This increases the chances of excess slack reaching the second chute, even if the product bounces around within the first chute and/or there is significant air movement within the first chute which causes the excess slack to move in different directions from the product.

According to a third aspect, there is provided a packaging apparatus comprising: the apparatus described above and packaging filling apparatus located at a lower end of the first chute. The packaging filling apparatus is arranged such that contents of the hopper received by the first chute pass under gravity smoothly down the receiving surface of the chute into an item of packaging. The packaging apparatus further comprises sealing apparatus configured to seal the item of packaging once contents of the hopper received by the first chute have passed down the receiving surface into the item of packaging. This arrangement reduces the chances of any slack coating the product becoming dislodged since there should be no jolting of the product as it slides down the receiving surface of the chute into the item of packaging. The lack of any jolts should also reduce the quantity of slack particles floating in the air (as opposed to those sliding together with the product down the receiving surface of the chute), which lessens the risk of floating particles becoming caught in the seal and reducing its quality.

According to a fourth aspect, there is provided a method of diverting excess slack away from a mixture of product and slack. The method comprises:

a) introducing a mixture of product and slack into a hopper comprising a gate moveable between open and closed positions, while the gate is in the closed position blocking a first path out of the hopper and thereby retaining product in the hopper, but permitting slack to exit the hopper via a second path;

b) subsequently moving the gate into the open position such that contents of the hopper exit the hopper via the first path; and c) subsequently moving the gate into the closed position such that the first path is blocked and excess slack remaining in the hopper exits the hopper via the second path.

In some embodiments the hopper may comprise a second gate moveable between open and closed positions, and step a) may be performed while the first and second gates are in their respective closed positions blocking a first path out of the hopper and thereby retaining product in the hopper, but permitting slack to exit the hopper via a second path.

Step b) may comprise moving the first and second gates into their respective open positions such that contents of the hopper exit the hopper via the first path, and step c) may comprise moving the first and second gates into their respective closed positions such that the first path is blocked and excess slack remaining in the hopper exits the hopper via the second path.

Preferably step b) comprises moving the first and second gates into their respective open positions substantially simultaneously. Opening both gates at the same time or in unison reduces the chance that the contents of the hopper adhere to the gates or the inside of the hopper. Thus product may be discharged more accurately and reliability is improved.

Such steps involve opening and closing both of the gates to discharge product and slack from the hopper. However, in some alternative cases product and slack could also be released from the hopper via the first path in step b) by opening a single gate of the first and second gates (i.e. by moving either the first gate or second gate into its respective open position). In this case only the corresponding gate opened in step b) would need to be returned back to its respective closed position in step c).

The method can further comprise repeating all of steps a) to c) consecutively, wherein the second iteration of step b) occurs at least 400 ms after the first iteration of step c). The pause allows time for the excess slack to exit the hopper.

The method can further comprise, following step a):

(i) obtaining a time series of a plurality of weight measurements of the contents of the hopper; and (ii) making a determination, based on the plurality of weight measurements, that the weight of the hopper contents has stabilised;

wherein step b) is only performed once said determination has been made. This ensures that all excess slack which can exit the hopper via the second path has done so before the gate is opened to allow the remaining hopper contents to exit via the first path.

The method can further comprise:

I. concurrently with step b), allowing the contents of the hopper exiting the hopper via the first path to pass smoothly under gravity from the hopper into an item of packaging; and II. subsequently sealing the item of packaging. This reduces the chances of any slack coating the product becoming dislodged, since there should be no jolting of the product in the transition from the hopper to the item of packaging.

The method can further comprising filtering slack out of contents of the hopper exiting the hopper via the first path.

The hopper used in the method can be the hopper described above. The method can be performed using the apparatus described above.

BRIEF DESCRIPTION OF THE FIGURES

Aspects of the present disclosure will now be described by way of example with reference to the accompanying figures. In the figures.

DETAILED DESCRIPTION OF THE FIGURES

The following description is presented to enable any person skilled in the art to make and use the system, and is provided in the context of a particular application. Various modifications to the disclosed embodiments will be readily apparent to those skilled in the art.

There will now be described a hopper which can be used for separating excess slack from a mixture of product and slack. The hopper has a gate which can be opened and closed. When the gate is open any product and/or slack contained in the hopper is free to exit via a first path. When the gate is closed it blocks the first path, but there is a second path out of the hopper available which allows any slack contained in the hopper to exit. The second path is configured such that it cannot be used by product, only slack. In this way, excess slack can be separated from a mixture of product and slack.

Figure 1A:
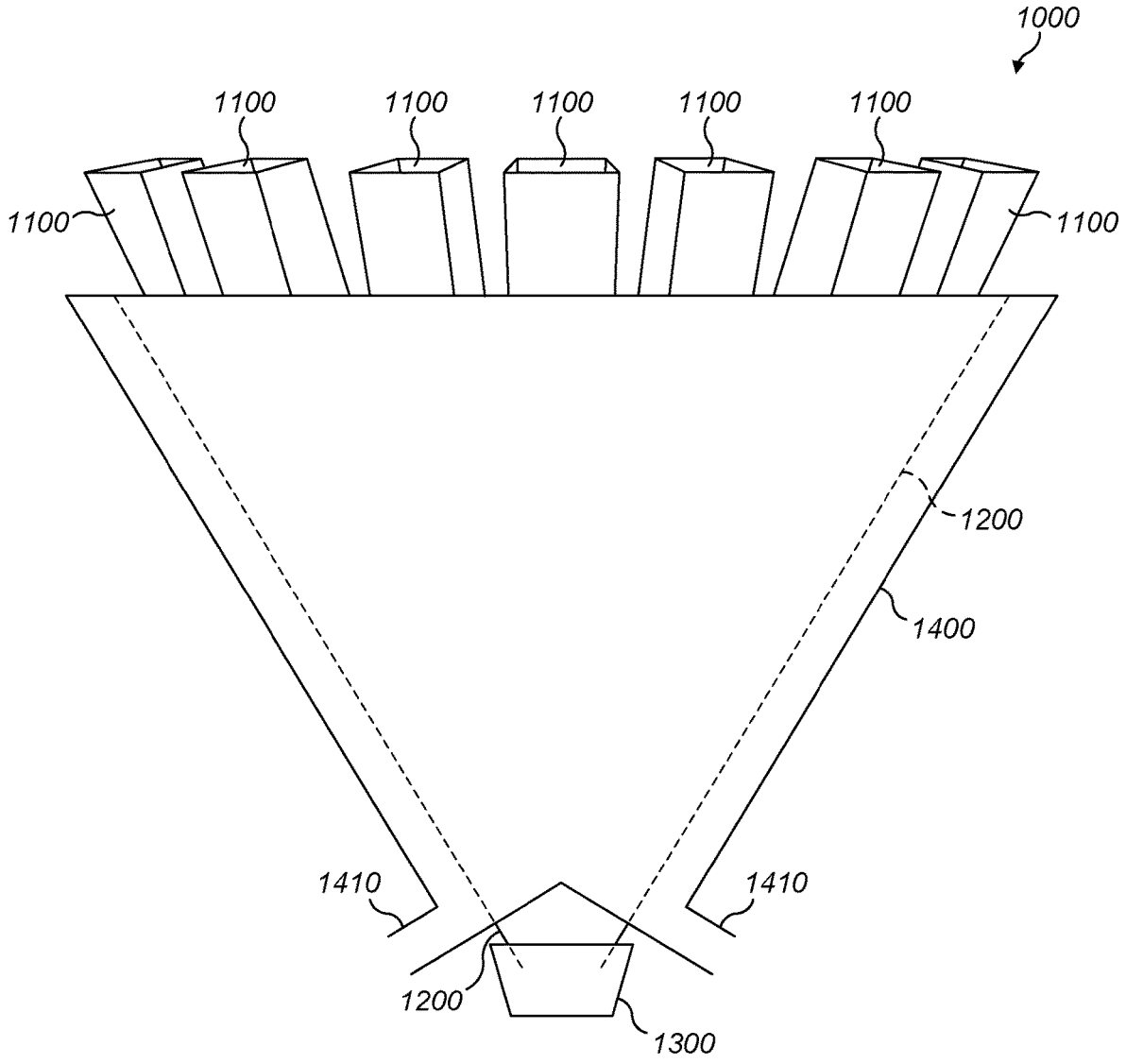
FIG. 1A illustrates example apparatus for use in a packaging process.

FIG. 1A shows an example of how such a hopper could be used in a packaging process.

In the example apparatus 1000 illustrated pool hoppers (not shown) drop a mixture of product and slack, such as jelly sweets in sugar, into a ring of weigh hoppers 1100.

The weigh hoppers 1100 comprise sensors (not shown) to allow the weight of their contents to be measured. In this way, a plurality of the weigh hoppers can be selected, for example by means of computer control, to have their contents combined into a package having a weight as close as possible to a target weight, e.g. 250 g.

Once the plurality of weigh hoppers 1100 have been selected, they open gates (not shown), which allows contents of those selected hoppers to drop down through a discharge chute 1200 (shown using dotted lines to illustrate its hidden location) into a timing hopper 1300.

The timing hopper 1300 then drops its contents into a packaging bag (not shown), which is subsequently sealed. The process may then be repeated.

In this example, both the weigh hoppers 1100 and the discharge chute 1200 are used to separate excess slack out of the mixture of product and slack provided by the pool hoppers, into a slack chute 1400. Slack is then extracted from the slack chute 1400 at connections 1410 and is fed back into the pool hoppers to reduce wastage.

The discharge chute 1200 is concentrically surrounded by the slack chute 1400, with the two chutes being spaced apart so that slack can pass between them. The discharge chute 1200 is formed of a mesh having apertures smaller than the average product size, so that product cannot pass through the mesh, but larger than the average size of a slack particle, so that slack can pass through the mesh into the slack chute 1400. The discharge chute 1200 therefore acts as a slack filter.

The apparatus is all arranged such that the last shock to the slack-coated product before it is dispensed into packaging is when it is dropped into the weigh hoppers 1100. In this way, the quantity of coating dislodged from the product beyond this point is minimised. This reduces the risk of free-floating slack interrupting the bag seal and reduces the quantity of free-floating slack in the final package.

Figure 1B:
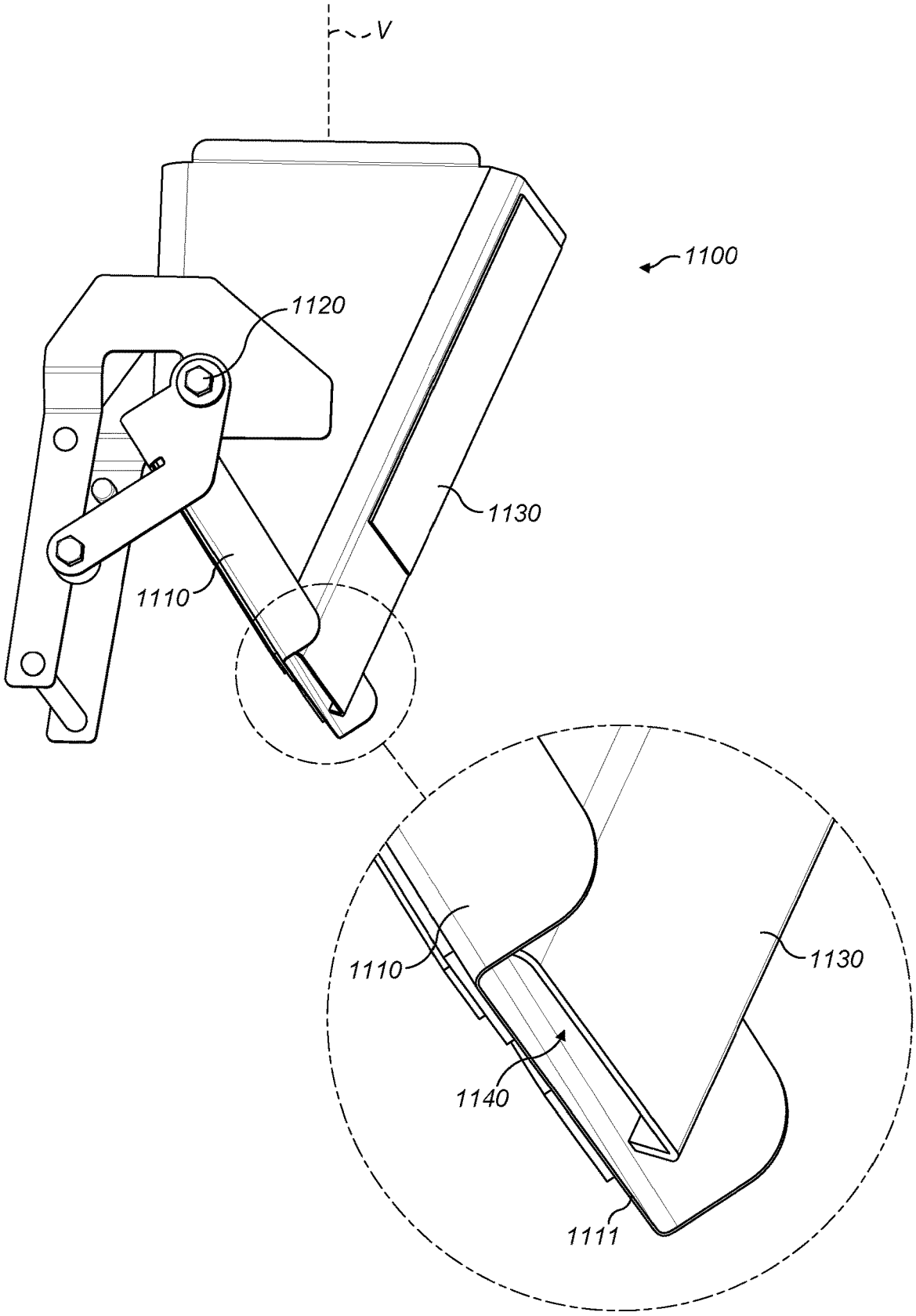
FIG. 1B provides detail on a hopper of FIG. 1B.
Figure 1D:
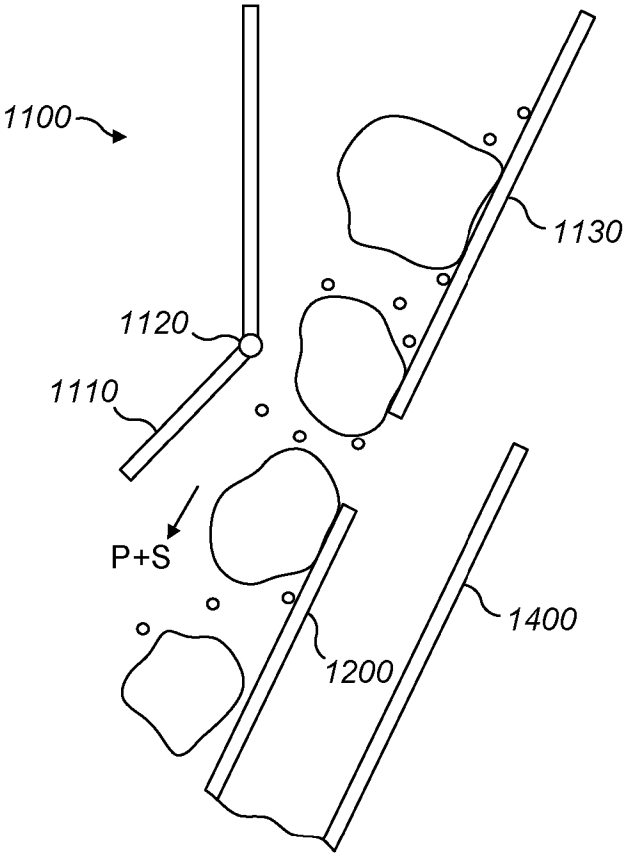
FIG. 1D is a similar schematic showing the example weigh hopper open.
Figure 1C:
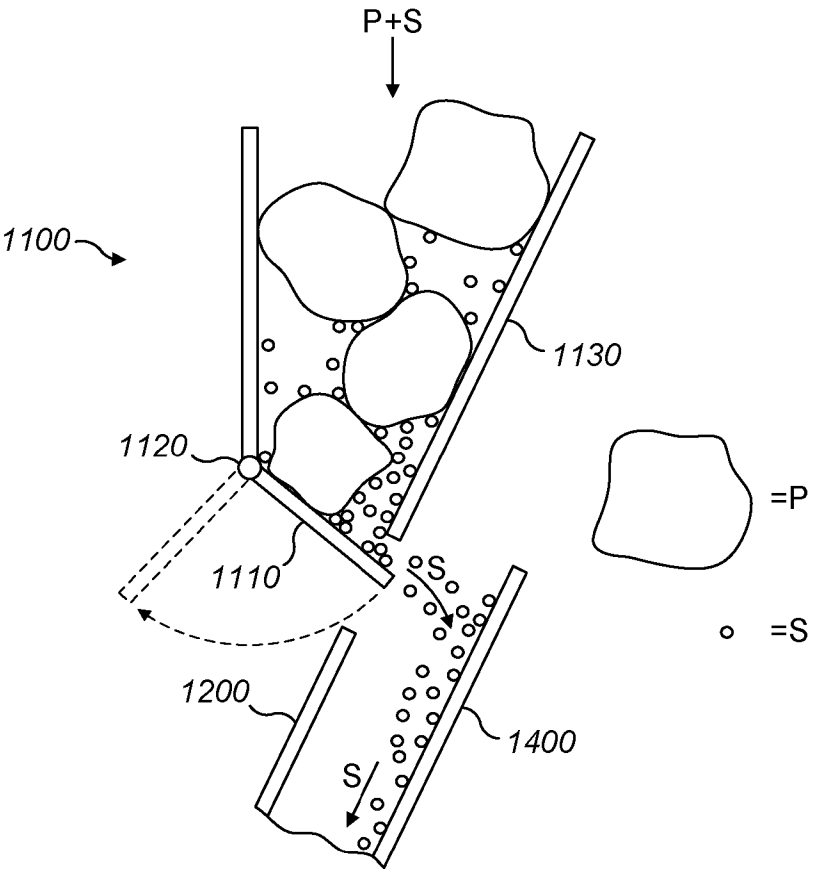
FIG. 1C is a schematic cross-section of part of the example apparatus shown in FIG. 1A with the example weigh hopper closed.

The weigh hoppers 1100 of FIG. 1A, and how they separate excess slack from the mixture of product of slack introduced into them, will now be described in further detail in relation to FIGS. 1B to 1D. FIG. 1B is a three dimensional drawing of an example weigh hopper 1100. FIG. 1C is a schematic cross-section of part of the example apparatus 1000 shown in FIG. 1A with the example weigh hopper 1100 closed. FIG. 1D is a similar schematic showing the example weigh hopper 1100 open.

FIG. 1B shows a weigh hopper 1100 with its gate 1110 in a closed position. The gate 1110 is controllable to move between the closed position and an open position about a hinge 1120, as illustrated by FIGS. 1C and 1D.

In the closed position the gate 1110 is angled with respect to the vertical, as indicated by the line marked V. A retaining wall 1130 of the hopper is also angled with respect to the vertical and slopes down towards the gate 1110, stopping just short of it to leave a gap 1140 large enough for slack to fit through but not large enough for product to fit through. A lip 1111 of the gate 1110 protrudes beyond the retaining wall 1130.

When the mixture of product and slack (P+S in FIG. 1C) is introduced into the closed hopper 1100, the product is retained between the gate 1110 and the retaining wall 1130. However excess slack (S) flows out over the lip 1111 and into the slack chute 1400.

In order to allow time for the contents of the hopper to settle and thus for the weight of the hopper contents to stabilise, a delay time of, for example, 800 ms can be introduced between closing and opening of the gate 1110.

Alternatively or additionally, the weight of the weigh hopper contents can be continuously monitored so that selection of the appropriate weigh hoppers, and opening of their respective gates, can be performed as soon as the weight of all of the weigh hoppers has stabilised, but not before. For example, weight measurements can be taken of the contents of each of the hoppers on a periodic basis, for example once every 10 ms. The weight of the contents of a particular hopper could be determined to have stabilised if three consecutive measurements are of the same value, or within a range of, for example, 0.15 g.

When the gate 1110 is opened, as shown in FIG. 1D, whatever contents remains in the hopper slides smoothly off the retaining wall 1130 onto a receiving surface of the discharge chute 1200, which is at substantially the same angle to the vertical as the retaining wall 1130 in order to reduce the risk of product coating being dislodged in the transition.

In some alternative examples, instead of both the gate and the retaining wall being at an acute angle to the vertical when the gate is closed, the retaining wall could be vertical, with the discharge chute directly below.

In some alternative examples, the lip of the gate could bend so that slack is directed off the lip in a different direction to the direction in which the rest of the gate extends.

In some alternative examples the gap could be filled with a mesh to filter out excess slack. In those examples the gap could be larger, since product would be prevented from falling through it by the mesh.

In some alternative examples, the gate could slide back out of the way of the top of the discharge chute to open the hopper, instead of pivoting.

In some alternative examples, suction could be used to remove excess slack instead of gravity. For example, the gap for slack egress could be not at the lower end of the hopper but higher up, in one of the hopper walls, and could connect to a vacuum pump so that excess slack can be sucked from the hopper.

In all of the above examples, a hopper is provided for diverting excess slack away from a mixture of product and slack. The hopper comprises a gate moveable between open and closed positions. The gate is configured such that, when the gate is in the open position a first path is provided for contents of the hopper, comprising a mixture of product and slack, to exit the hopper. When the gate is in the closed position the first path is closed by the gate so that product is retained in the hopper and a second path, different from the first path, is provided for slack to exit the hopper.

The first path can comprise a first aperture sized to permit egress of both product and slack and the second path can comprise a second aperture (such as the gap 1440 of the example of FIG. 1) sized to permit egress of slack but not of product.

The first and second apertures can be located so that product and/or slack can fall through them under gravity as in the example of FIGS. 1.

Alternatively, the product and/or slack could be conveyed out of the hopper by other means, for example suction, e.g. slack could be allowed to settle in the hopper together with product, but then siphoned off from above. In that case, depending on the type of product and slack, the aperture through which the slack is sucked could in fact be large enough to admit egress of product, so long as the vacuum is weak enough that it will never pick up any of the product, only the slack.

The hopper could comprise a retaining wall, wherein the hopper is configured such that the second aperture is a gap between the gate, when in the closed position, and a lower end of the retaining wall, as in the example of FIG. 1.

The hopper can be configured such that when the gate is in the open position the first path directs contents of the hopper out of the hopper under gravity in a first direction; and when the gate is in the closed position the second path directs slack out of the hopper under gravity in a second direction, angled with respect to the first direction. The first direction could be vertical. Alternatively, both the first and second directions could be at an angle to the vertical, as in the examples of FIG. 1.

The retaining wall can be at an acute angle to the vertical such that, when the gate is in the open position, contents of the hopper pass over the retaining wall out of the hopper in the first direction as in the examples of FIG. 1. Depending on the type of hopper contents, it may slide, flow or roll over the retaining wall.

The hopper can be configured such that, when the gate is in the closed position, the gate is at an acute angle to the vertical such that slack passes over the gate out of the hopper in the second direction, as in the examples of FIG. 1.

The hopper can be configured such that there is a lateral offset between where contents of the hopper exit the hopper via the first path and where slack exits the hopper via the second path. (This is the case in the example of FIG. 1, though it need not be for examples where excess slack is separated by suction.)

The hopper can be configured such that, when the gate is in the closed position, a distal end of the gate is laterally offset from the lower end of the retaining wall to form a lip as in the examples of FIG. 1.

The hopper can be configured such that, when the gate is in the closed position, the gate and the retaining wall slope towards one another, with the retaining wall stopping short of the gate to form the gap and the gate extending beyond where the gate and the retaining wall would otherwise intersect, as in the example of FIG. 1.

The hopper can comprise a hinge, such as the hinge 1120 of FIG. 1, wherein the gate is configured to be moveable between the open and closed positions by rotation about the hinge as in the example of FIG. 1. Alternatively, the gate could be configured to slide between the open and closed positions.

The hopper can be a weighhopper—i.e. a hopper capable of weighing its contents—but it is not essential. In some examples the hopper may additionally or alternatively be a pool hopper, booster hopper, timing hopper, output hopper or discharge hopper.

Apparatus for separating excess slack from a mixture of product and slack can comprise: any of the hoppers described above; a first chute located so as to receive contents of the hopper exiting the hopper via the first path when the gate is in the open position, such as the discharge chute 1200 of the example of FIG. 1; and a second chute located so as to receive slack exiting the hopper via the second path when the gate is in the closed position, such as the slack chute 1400 of the example of FIG. 1.

The first chute can be arranged with respect to the retaining wall of the hopper such that, when the gate is in the open position, contents of the hopper pass under gravity smoothly from the retaining wall of the hopper onto a receiving surface of the chute, as in the example of FIGS. 1.

The first chute can be formed as a filter configured to permit slack entering the first chute to exit through the first chute into the second chute, but not to permit product entering the first chute to exit through the first chute into the second chute, as described above in relation to the example of FIG. 1.

The second chute can be arranged concentrically around the first chute, as in the example of FIG. 1.

Packaging apparatus can comprise: the apparatus described above; packaging filling apparatus located at a lower end of the first chute and arranged such that contents of the hopper received by the first chute pass under gravity smoothly down the receiving surface of the chute into an item of packaging; and sealing apparatus configured to seal the item of packaging once contents of the hopper received by the first chute have passed down the receiving surface into the item of packaging. Alternatively, instead of providing the first chute to transport product into an item of packaging, the contents of the hopper could be dropped directly into an item of packaging before it is sealed.

Figure 2:
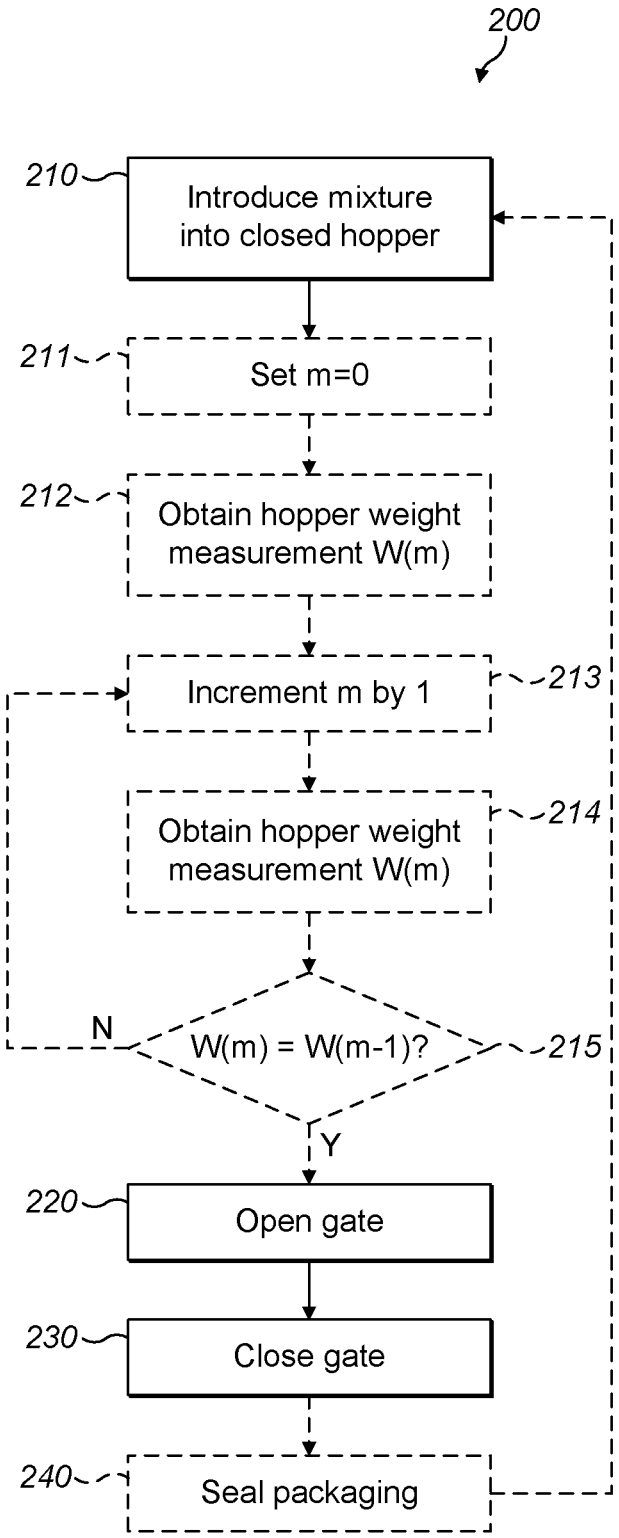
FIG. 2 is a flowchart of an example method of separating excess slack from a mixture of product and slack.

FIG. 2 is a flowchart illustrating an example method 200 of diverting excess slack away from a mixture of product and slack, where dotted lines indicate optional steps. At step 210 a mixture of product and slack is introduced into a hopper comprising a gate moveable between open and closed positions, while the gate is in the closed position blocking a first path out of the hopper and thereby retaining product in the hopper, but permitting slack to exit the hopper via a second path.

At step 220 the gate is then moved into the open position such that contents of the hopper exit the hopper via the first path.

At step 230 the gate is then moved into the closed position such that the first path is blocked and excess slack remaining in the hopper exits the hopper via the second path.

These steps can optionally be repeated.

Optionally, between steps 210 and 220, there may be further steps 211 to 215 to obtain a time series of a plurality of weight measurements of the contents of the hopper and make a determination, based on the plurality of weight measurements, that the weight of the hopper contents has stabilised. In the illustrated example this is achieved by setting an integer m to zero at step 211, obtaining a hopper weight measurement W(m) at step 212, incrementing m by one at step 213, obtaining a further hopper weight measurement W(m) at step 214 and determining whether W(m)=W(m−1) at step 215. If the answer is yes then the weight of the hopper has stabilised and the flow proceeds to step 220. If the answer is no then the flow returns to step 213.

Concurrently with step 220 the contents of the hopper exiting the hopper via the first path can optionally be allowed to pass smoothly under gravity from the hopper into an item of packaging and the item of packaging can optionally be sealed at step 240.

Slack can optionally be filtered out of contents of the hopper exiting the hopper via the first path.

The method 200 can optionally use the apparatus of the example of FIG. 1.

Equally, the method 200 may use an apparatus as shown in FIG. 3, which shows a hopper 2100 having two gates 2110, 2132. These gates 2110, 2132 may be opened and closed together so as to open and block the first path. Such examples with two gates are particularly well suited for use with sticky products (e.g. meat coated with a marinade, sticky sweets) which may otherwise adhere to a stationary retaining wall, especially in hoppers with angled retaining walls 1130 as shown in FIG. 1.

Figure 3B:
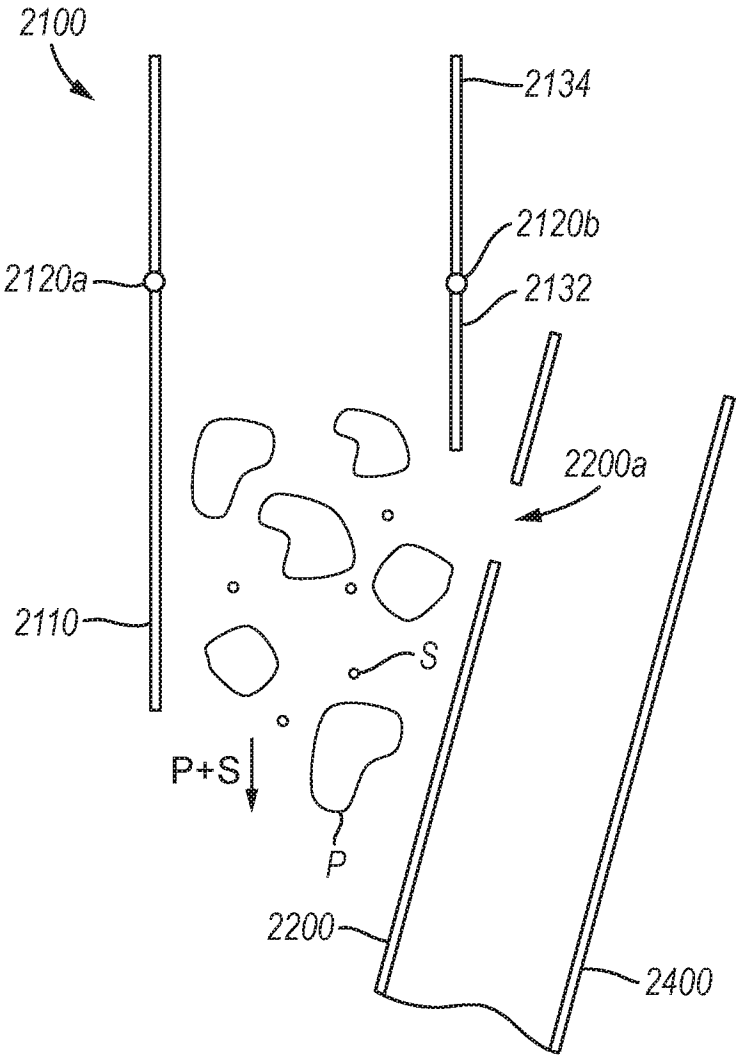
FIG. 3A is a schematic cross-section of an example apparatus for use in a packaging process shown with the gates of an example hopper closed; and, FIG. 3B is a schematic cross-section showing the gates of the example hopper shown in FIG. 3A open.
Figure 3A:
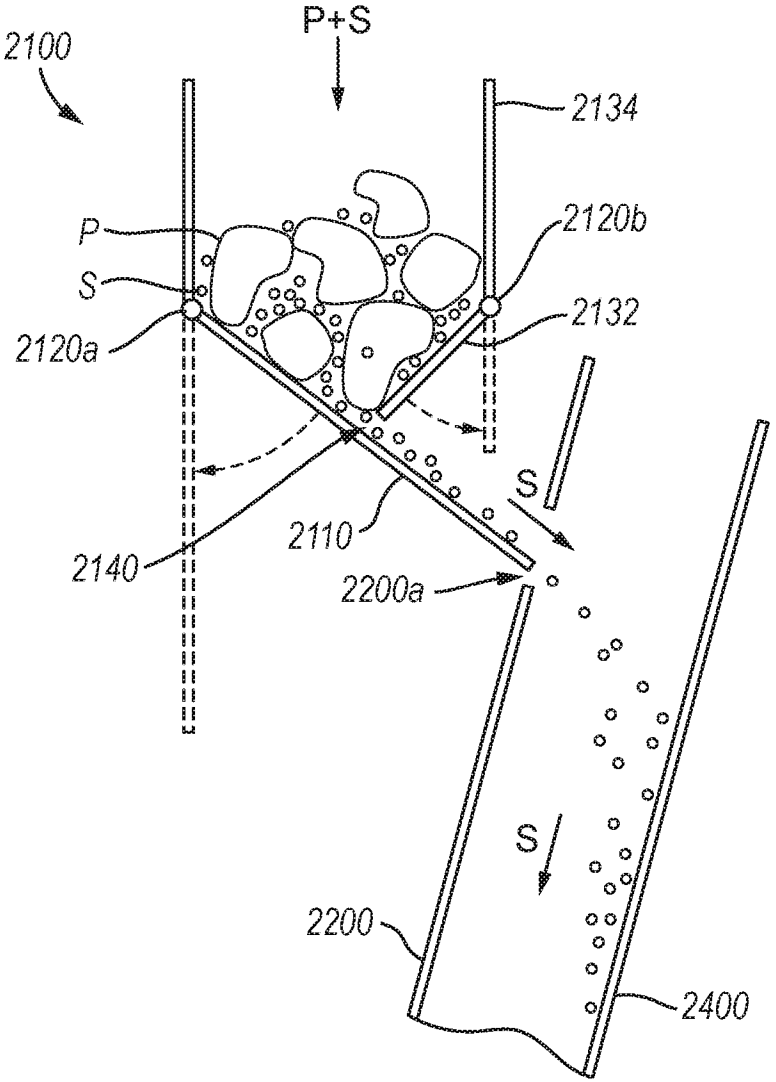

In more detail, FIGS. 3A and 3B show a hopper 2100 with a movable first gate 2110 and an opposing moveable second gate 2132. The second gate 2132 forms the lower portion of a retaining wall which further comprises an upper fixed portion 2134. Thus, the features of the lower end of the retaining wall discussed above apply correspondingly to the lower end of the second gate 2132.

The hopper 2100 of FIG. 3 can also be used for separating excess slack from a mixture of product and slack. When the gates 2110, 2132 are in their respective open positions any product and/or slack contained in the hopper 2100 is free to exit the hopper 2100 via a first path. When the gates 2110, 2132 are in their respective closed positions they combine to block or close the first path, retaining product in the hopper 2100. However, when the gates 2110, 2132 are in their respective closed positions a second path from the hopper 2100 is provided through which slack (which is typically a liquid and/or of relatively small dimensions relative to the product) may exit the hopper 2100. The second path is configured such that it cannot be used by product only slack. In this way, excess slack can be separated from a mixture of product and slack.

Also shown in FIGS. 3A and 3B are a discharge chute 2200 concentrically surrounded by a slack chute 2400, the two chutes being spaced apart so that slack can pass between them. The discharge chute 2200 is preferably formed of a mesh having apertures smaller than the average product size, so that product cannot pass through the mesh, but larger than the average size of a slack particle, so that slack can pass through the mesh into the slack chute 2400. Such a discharge chute 2200 therefore acts as a slack filter.

FIG. 3A shows the hopper 2100 in a closed arrangement, when each of the first and second gates 2110, 2132 are in respective closed positions. As shown in this respective closed position the first gate 2110 is angled with respect to the vertical. Whereas, the second gate 2132 of the hopper 2100 is also angled with respect to the vertical and slopes down towards the first gate 2110, stopping just short of it to leave a gap 2140 (i.e. a second aperture) large enough for slack to fit through but not large enough for product to fit through. The first gate 2110 is longer than the second gate 2132, extending past the point where the first gate 2110 and second gate 2132 would otherwise intersect.

When a mixture of product and slack (P+S in FIG. 3A) is introduced into the closed hopper 2100, the product is retained by the first and second gates 2110, 2132. However excess slack (S) flows out through a gap 2140 left between the first and second gates 2110, 2132. This gap 2140 between the gates 2110, 2132 through which the second path extends is smaller than the average minimum dimension of the product but larger than the average largest dimension of the slack. Thus slack passes through the gap 2140 and is separated from product.

The separated slack S passes over the longer first gate 2110, through an aperture 2200*a* (e.g. a hole or slot) in the discharge chute 2200 and into the slack chute 2400. In further embodiments in which the discharge chute 2200 is a mesh the slack S may pass through the discharge chute 2200 without the need for any further apertures. In some cases, the slack entering the discharge chute 2200 may be collected and reintroduced to the processing line at an earlier state.

FIG. 3B shows the hopper 2100 in an arrangement when the first and second gates 2110, 2132 are in their respective open positions. These open positions 2110, 2132 are substantially vertical, as may occur if the first and second gates 2110, 2132 are allowed to fall under gravity. However, the gates 2110, 2132 may be held in alternative positions.

In this open arrangement, the contents of the hopper 2100 (i.e. the product P and any remaining slack S) is released under gravity along a first path into the discharge chute 2200, as indicated by the arrow P+S. This first path extends between the open gates 2110, 2132 between which is defined an aperture (i.e. the first aperture) which is sized to permit egress of both product and slack since the minimum distance between the gates 2110, 2132 is greater than the maximum dimension of each of the product and slack.

As discussed above, the product P which has travelled along this first path may then be packaged using a packaging machine with reduced levels of slack S.

As shown, the first and second gates 2110, 2132 rotate about hinges 2120*a*, 2120*b* so as to move between their respective closed and open positions (as indicated by the dash arrows and gates shown in FIG. 3A). However, this is not essential and one or more of the gates 2110, 2132 could move in an alternative manner (e.g. sliding).

Preferably the first and second gates 2110, 2132 are opened substantially simultaneously—i.e. at the same time or in unison, rather than the gates 2110, 2132 being opened sequentially. Moving both gates 2110, 2132 together provides a significant shock to the contents of the hopper 2100, which acts to prevent sticky product from adhering to the inside of the hopper 2100 and not being discharged. However, in further embodiments the gates 2110, 2132 may be opened sequentially (e.g. to avoid unnecessary impacts to dry products which would generate more slack).

As will be appreciated from the FIGS. 3A and 3B, the first path in which product and slack may pass and the second path along which only slack travels are laterally offset and extend in different directions. However, this is not essential (e.g. in cases where slack is removed from the hopper by suction).

The hopper may be controlled and weighed as discussed above in reference to FIGS. 1 and 2. For instance a delay time of, for example, 800 ms can be introduced between closing and opening of the gate to allow the contents to stabilise before weighing. Alternatively, the weight of the hopper can be continuously or periodically monitored and a final weight measurement be taken when the weight has stabilised.

Similarly, in further embodiments the hopper 2100 shown in FIG. 3 may additionally comprise any of the optional or preferable features discussed above with reference to FIGS. 1 and 2. For instance, the first gate 2110 may comprise a curved or angled lip such that, when the first gate 2110 is closed, slack travelling along the second path will be directed or steered in a desired direction.

Other embodiments will be apparent to those skilled in the art from consideration of the specification and practice of the embodiments disclosed herein. It is intended that the specification and examples be considered as exemplary only.

The terms "top", "bottom", "side", "front", "back", "forward", "rear" and other terms describing the orientation of features are not intended to be limiting and are purely included in order to facilitate the description of the relative location of these features in the context of the accompanying drawings. In use, or during storage, the features may be disposed in other orientations.

In addition, where this application has listed the steps of a method or procedure in a specific order, it could be possible, or even expedient in certain circumstances, to change the order in which some steps are performed, and it is intended that the particular steps of the method or procedure claims set forth herein not be construed as being order-specific unless such order specificity is expressly stated in the claim. That is, the operations/steps may be performed in any order, unless otherwise specified, and embodiments may include additional or fewer operations/steps than those disclosed herein. It is further contemplated that executing or performing a particular operation/step before, contemporaneously with, or after another operation is in accordance with the described embodiments.

The invention claimed is:

1. A hopper for diverting excess slack away from a mixture of product and slack, the hopper comprising a first gate moveable between open and closed positions and a retaining wall, wherein the first gate is configured such that:

when the first gate is in the open position a first path is provided for contents of the hopper, comprising a mixture of product and slack, to exit the hopper; and when the first gate is in the closed position the first path is closed by the first gate so that product is retained in the hopper and a second path, different from the first path, is provided for slack to exit the hopper; and wherein there is a lateral offset between where contents of the hopper exit the hopper via the first path and where slack exits the hopper via the second path;

the hopper being further configured such that, when the first gate is in the closed position, the first gate and the retaining wall slope towards one another, with the retaining wall stopping short of the first gate to form a gap and the first gate extending beyond where the first gate and the retaining wall would otherwise intersect such that a distal end of the first gate is laterally offset from the lower end of the retaining wall.

2. The hopper of claim 1, wherein the first path comprises a first aperture sized to permit egress of both product and slack and the second path comprises a second aperture sized to permit egress of slack but not of product.

3. The hopper of claim 2, wherein the hopper is configured such that the second aperture is the gap between the first gate, when in the closed position, and the lower end of the retaining wall.

4. The hopper of claim 1, configured such that:

when the first gate is in the open position the first path directs contents of the hopper out of the hopper under gravity in a first direction; and when the first gate is in the closed position the second path directs slack out of the hopper under gravity in a second direction, angled with respect to the first direction.

5. The hopper of claim 4, wherein;

the retaining wall is at an acute angle to the vertical such that, when the first gate is in the open position, contents of the hopper pass over the retaining wall out of the hopper in the first direction; and/or, the hopper is configured such that, when the first gate is in the closed position, the first gate is at an acute angle to the vertical such that slack passes over the first gate out of the hopper in the second direction.

6. Apparatus for separating excess slack from a mixture of product and slack, the apparatus comprising:

the hopper according to claim 1;

a first chute located so as to receive contents of the hopper exiting the hopper via the first path when the first gate is in the open position; and a second chute located so as to receive slack exiting the hopper via the second path when the first gate is in the closed position.

7. The apparatus of claim 6, wherein the first chute is formed as a filter configured to permit slack entering the first chute to exit through the first chute into the second chute, but not to permit product entering the first chute to exit through the first chute into the second chute.

8. Packaging apparatus comprising:

the apparatus of claim 6;

a packaging filling apparatus located at a lower end of the first chute and arranged such that contents of the hopper received by the first chute pass under gravity down a receiving surface of the first chute into an item of packaging; and a sealing apparatus configured to seal the item of packaging once contents of the hopper received by the first chute have passed down the receiving surface into the item of packaging.

9. A method of diverting excess slack away from a mixture of product and slack, the method comprising the steps of:

a) introducing a mixture of product and slack into the hopper according to claim 1 while the first gate is in the closed position blocking a first path out of the hopper and thereby retaining product in the hopper, but permitting slack to exit the hopper via a second path;

b) subsequently moving the first gate into the open position such that contents of the hopper exit the hopper via the first path; and c) subsequently moving the first gate into the closed position such that the first path is blocked and excess slack remaining in the hopper exits the hopper via the second path.

10. The method of claim 9, further comprising:

repeating all of steps a) to c) consecutively, wherein the second iteration of step b) occurs at least 400 ms after the first iteration of step c); and/or following step a): obtaining a time series of a plurality of weight measurements of the contents of the hopper; and making a determination, based on the plurality of weight measurements, that the weight of the hopper contents has stabilised; wherein step b) is only performed once said determination has been made; and/or, concurrently with step b), allowing the contents of the hopper exiting the hopper via the first path to pass under gravity from the hopper into an item of packaging; and subsequently sealing the item of packaging.

11. The method of claim 9, further comprising filtering slack out of contents of the hopper exiting the hopper via the first path.

12. A hopper for diverting excess slack away from a mixture of product and slack, the hopper comprising a first gate moveable between open and closed positions and a retaining wall, wherein the first gate is configured such that:

when the first gate is in the open position a first path is provided for contents of the hopper, comprising a mixture of product and slack, to exit the hopper; and when the first gate is in the closed position the first path is closed by the first gate so that product is retained in the hopper and a second path, different from the first path, is provided for slack to exit the hopper;

and wherein the retaining wall comprises a second gate moveable between open and closed positions, such that:

when the first and second gates are in their respective open positions the first path extends between the first and second gates; and when the first and second gates are in their respective closed positions the first path is blocked and the second path extends between the first and second gates;

wherein there is a lateral offset between where contents of the hopper exit the hopper via the first path and where slack exits the hopper via the second path;

the hopper being further configured such that, when the first and second gates are in their respective closed positions, the first and second gates slope towards one another, with the second gate stopping short of the first gate to form a gap and the first gate extending beyond where the gates would otherwise intersect such that a distal end of the first gate is laterally offset from a distal end of the second gate.

13. The hopper of claim 12, wherein the first path comprises a first aperture sized to permit egress of both product and slack and the second path comprises a second aperture sized to permit egress of slack but not of product.

14. The hopper of claim 13, wherein the hopper is configured such that the second aperture is the gap between the first gate, when in the closed position, and the lower end of the second gate.

15. The hopper of claim 12, configured such that:

when the first gate is in the open position the first path directs contents of the hopper out of the hopper under gravity in a first direction; and when the first gate is in the closed position the second path directs slack out of the hopper under gravity in a second direction, angled with respect to the first direction.

16. The hopper of claim 15, wherein the retaining wall is at an acute angle to the vertical such that, when the first gate is in the open position, contents of the hopper pass over the retaining wall out of the hopper in the first direction; and/or the hopper is configured such that, when the first gate is in the closed position, the first gate is at an acute angle to the vertical such that slack passes over the first gate out of the hopper in the second direction.

17. The hopper of claim 12, configured to move the first and second gates between their respective closed and open positions substantially simultaneously.

18. The hopper of claims 12, wherein the length of the first gate is at least 1.2 times greater than the length of the second gate.

19. A method of diverting excess slack away from a mixture of product and slack, the method comprising the steps of:

a) introducing a mixture of product and slack into the hopper according to claim 5 while the first and second gates are in their respective closed positions blocking a first path out of the hopper and thereby retaining product in the hopper, but permitting slack to exit the hopper via a second path;

b) subsequently moving the first and second gates into their respective open positions such that contents of the hopper exit the hopper via the first path; and c) subsequently moving the first and second gates into their respective closed positions such that the first path is blocked and excess slack remaining in the hopper exits the hopper via the second path.

20. The method of claim 19, further comprising:

repeating all of steps a) to c) consecutively, wherein the second iteration of step b) occurs at least 400 ms after the first iteration of step c);

following step a): obtaining a time series of a plurality of weight measurements of the contents of the hopper; and making a determination, based on the plurality of weight measurements, that the weight of the hopper contents has stabilised; wherein step b) is only performed once said determination has been made; and/or concurrently with step b), allowing the contents of the hopper exiting the hopper via the first path to pass under gravity from the hopper into an item of packaging; and subsequently sealing the item of packaging.

21. The method of claim 19, further comprising filtering slack out of contents of the hopper exiting the hopper via the first path.

22. Apparatus for separating excess slack from a mixture of product and slack, the apparatus comprising:

the hopper according to claim 12;

a first chute located so as to receive contents of the hopper exiting the hopper via the first path when the first gate is in the open position; and a second chute located so as to receive slack exiting the hopper via the second path when the first gate is in the closed position.

* * * * *